US006438811B1

(12) United States Patent
Watanabe

(10) Patent No.: US 6,438,811 B1
(45) Date of Patent: Aug. 27, 2002

(54) MALE/FEMALE ENGAGING DEVICE WITH TAPE

(75) Inventor: Hirokazu Watanabe, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/567,628

(22) Filed: May 9, 2000

(30) Foreign Application Priority Data

May 11, 1999 (JP) ..... 11-129368

(51) Int. Cl.[7] ..... A44B 17/00
(52) U.S. Cl. ..... 24/697.2; 24/697.1; 24/662
(58) Field of Search ..... 24/697.1, 697.2, 24/406, 414, 662, 681

(56) References Cited

U.S. PATENT DOCUMENTS

| | | | | |
|---|---|---|---|---|
| 573,829 | A | * | 12/1896 | Mixer et al. |
| 1,495,118 | A | | 5/1924 | Starck |
| 2,114,429 | A | | 4/1938 | Roseman |
| 2,500,694 | A | * | 3/1950 | Matsumoto |
| 2,709,290 | A | * | 5/1955 | Rosenthal |
| 2,809,411 | A | * | 10/1957 | Moghadam |
| 3,160,935 | A | | 12/1964 | Broyles |
| 3,751,770 | A | * | 8/1973 | Italiano |
| 5,187,843 | A | * | 2/1993 | Lynch |
| 5,581,854 | A | * | 12/1996 | Swain |
| 6,058,577 | A | * | 5/2000 | Ida et al. |
| 6,182,338 | B1 | * | 2/2001 | Watanabe |
| 6,243,927 | B1 | * | 6/2001 | Matsushima et al. |

FOREIGN PATENT DOCUMENTS

| | | |
|---|---|---|
| GB | 2 333 802 A | 8/1999 |
| JP | 62-79416 | 5/1987 |
| JP | 2525301 | 3/1993 |

* cited by examiner

*Primary Examiner*—James R. Brittain
(74) *Attorney, Agent, or Firm*—Finnegan, Henderson, Farabow, Garrett & Dunner, LLP

(57) ABSTRACT

A male/female engaging device utilized with a pair of tapes constructed so that a gap between the pair of tapes is as small as possible and capable of providing a fashionable and beautiful appearance. Female engaging devices made of synthetic resin are attached to one side edge of one of the pair of tapes and male engaging devices are attached to one side edge of the other of the pair of tapes. Engagement or disengagement between a female engaging device and its corresponding male engaging device is carried out inside of the side edge of one of the tapes on which the female engaging device or the male engaging device is attached. In one embodiment, each female engaging device includes a vertical pair of engaging pieces protruded from a base portion for covering the side edge of one tape and each male engaging device includes a hooking portion for covering the side edge of the other tape so that the engaging pieces are capable of engaging the hooking portion. Because the female engaging devices and the male engaging devices are engaged at positions inside of a side edge of one of the tapes, the gap between the pair of tapes can be reduced.

2 Claims, 11 Drawing Sheets

MALE/FEMALE ENGAGING DEVICE WITH TAPE

BACKGROUND OF THE INVENTION

1. Field of the Invention

The present invention relates to a male/female engaging device with tape for use in clothes including foundation garments such as brassieres and body suit, inner wear, outer wear such as sports wear, and overall such as baby wear and infant wear.

2. Description of the Related Art

The conventional male/female engaging device employing male/female hooking tape for use in clothes including foundation garments, inner wear, outer wear, and overall for baby wear and infant wear has been disclosed in Japanese Utility Model Application Laid-Open No. 62-79416. According to a male-female engaging tape in this publication, as shown in FIG. 20, a core thread 5' is exposed along a side edge 4' of each of a pair of cloth tapes 3' which are folded back along a longitudinal direction thereof, and a female engaging device 1' molded of synthetic resin having an engaging hole 34' provided in a front half portion, and an attaching portion 8' provided in a rear half portion for nipping the tape 3' is mounted on a side edge of a tape 3' at a predetermined interval. A male engaging device 2' is molded integrally of synthetic resin, containing an hooking portion which is hooked on the engaging hole in the aforementioned front half portion, and an attaching portion 8' provided on a rear half portion for nipping the tape 3' is mounted on the side edge of the other tape at a predetermined interval.

Further, an engaging/disengaging device with tape has been disclosed in Japanese Patent Publication No. 2525301. According to this publication, as shown in FIG. 21, a male engaging/disengaging device 102 containing a neck portion 135 protruded sideways and an expanded head 124 perpendicular to this neck portion 135 is molded integrally of synthetic resin on a side edge of one of a pair of tapes 103, while a female engaging/disengaging device 101 containing an engagement groove which the neck portion 135 engages is molded integrally of synthetic resin, such that the engagement portions of the male and female engaging/disengaging devices and the attaching portions 108 thereof to the tape 103 are formed at the same height.

When in the male/female hooking tape shown in FIG. 20, the female hooking device and male hooking device are hooked on each other to join both tapes, since engagement points of the female engaging device and male engaging device is far from the side edge of the tape, there is generated a large gap between the side edges of the both tapes. Thus, when the male/female hooking tape is used, it does not have a good appearance and not fashionable. Further, because the female hooking device is a simple through hole and the male hooking device is a simple structure of a hook, there is a problem that the engagement between the both engaging devices is not stable when they are engaged.

Further, in the engaging/disengaging device with tape shown in FIG. 21, when the male engaging device is hooked on the female engaging device so as to join both tapes, because the engagement point between the male engaging device and female engaging device is far from the side edges of the tapes, there is generated a large through hole between the side edges of the tape. Consequently, when the engaging/disengaging device with tape is used, it does not have a good appearance and not fashionable. Further, if a twisting is generated between the male engaging/disengaging device and female engaging/disengaging device in an engagement state, the engagement may be released easily.

SUMMARY OF THE INVENTION

The present invention has been accomplished to solve the above problems. An object of the present invention is to provide a male/female engaging device with tape comprising a male engaging device having a hooking mechanism and a female engaging device having an engaging mechanism, both being attached to side edges of right and left tapes, a gap between the right and left tapes is formed to be as small as possible when they engage each other, providing male/female engaging device with tape with a fashionably beautiful appearance. Further, an object is to provide a male/female engaging device with tape in which engagement between the male engaging device and female engaging device can be achieved firmly and a strong holding force against a twisting action can be maintained.

Another object of the present invention is to provide a male/female engaging device with tape in which an engaging operation for combining the female engaging device having the engaging mechanism with the male engaging device having the hooking mechanism can be carried out very easily and the appearances of the female and male engaging devices are beautiful and excellent in terms of design.

Still another object of the present invention is to provide a male/female engaging device with tape in which the female engaging device having the engaging mechanism and the male engaging device having the hooking mechanism are formed in a rigid configuration and an engaging operation for combining the female engaging device with the male engaging device is achieved easily.

It is an object of the present invention to provide a male/female engaging device with tape in which an engaging operation for combining the female engaging device having an engaging mechanism with the male engaging device having hooking mechanism can be carried out relatively easily and especially a disengaging operation for releasing the engagement between the combined female engaging device and male engaging device can be achieved very easily.

To achieve the above object, there is provided a male/female engaging device with tape, wherein female engaging devices 1 having an engaging mechanism are attached to one of the side edges 4 opposing each other of a pair of tapes 3 while male engaging devices 2 having a hooking mechanism are attached to the other side edge 4, such that engagement or disengagement between the female engaging device 1 and male engaging device 2 is carried out in a position inside of the tape 3 with respect to one of the side edges 4 of the tape 3 on which the female engaging device 1 or male engaging device 2 is attached.

Preferably, there is provided a male/female engaging device with tape, wherein the male engaging device 2 having the hooking mechanism covers the side edge 4 of the tape 3 and contains a hooking portion 7 having guide faces 13 at an outer side thereof and a frame portion 9 which is formed in a U shape positioned inward from both ends of the hooking portion 7 and attached to the tape 3 such that the tape 3 is sandwiched thereby. The female engaging device 1 having the engaging mechanism includes a base portion 8 on the side edge 4 for covering the side edge 4 of the tape 3 and a vertical pair of engaging pieces 15 for engaging the hooking portion 7 of the male engaging device 2, provided on a front face of the base portion 8 so as to protrude.

Still preferably, there is provided a male/female engaging device with tape, wherein the male engaging device 2 having the hooking mechanism covers the side edge 4 of the tape 3 and has on the side edge 4 a hooking portion 7 having guide faces 13 at an outer side thereof, a frame portion 9 which is formed in a U shape positioned inward of the tape 3 from both ends of the hooking portion 7 and sandwiched to the tape 3 thereby to be fixed. A plurality of accommodating portions 12 are provided in the hooking portion 7 such that some partition walls 17 are provided between the hooking portion 7 so as to be connected to the frame portion 9. The female engaging device 1 having the engaging mechanism includes a base portion 8 for covering the side edge 4 of the tape 3, and plural vertical pairs of engaging pieces 15 which correspond to the accommodating portion 12 of hooking portion 7 engaging the hooking portions 7 of the male engaging device 2 provided on a front face of the base portion 8 so as to protrude.

Further preferably, there is provided a male/female engaging device with tape, wherein the female engaging device 1 having the engaging mechanism includes on the side edge 4 a base portion 8 so as to cover the side edge 4 of the tape 3, and an engaging hole 20 provided on a front face of the base portion 8 such that a male piece 23 of the male engaging device 2 is capable of passing through and the male engaging device 2 having the hooking mechanism includes on side edge 4 a base portion 8 so as to cover the side edge 4 of the tape 3 and the male piece 23 having an expanded head portion 24 at a front end thereof and protruded forward from the front face of the base portion 8.

It is preferable that there is provided a male/female engaging device with tape, wherein the female engaging device 1 having the engaging mechanism includes on the side edge 4 a base portion 8 so as to cover the side edge 4 of the tape 3, and hook shaped engaging protrusions 28 provided on both sides such that the male piece 23 of the male engaging device 2 is capable of being inserted in between the engaging protrusion 28 so that they are directed inward, the engaging protrusions 28 being provided on a top face or a bottom face of the base portion 8, for example top face, to face each other, and the male engaging device 2 having the hooking mechanism includes on the side edge 4 a base portion 8 so as to cover the side edge 4 of the tape 3 and the male piece 23 having an expanded head portion 25 with its end expanded and protruded forward from the front face of the base portion 8.

It is still preferable that there is provided a male/female engaging device with tape, wherein the male engaging device 2 having the hooking mechanism includes on the side edge 4 a base portion 8 so as to cover the side edge 4 of the tape 3, and engaging protrusions 29 having an engaging head portion 30 at a tip thereof, the engaging protrusion 29 being provided on a top face or a bottom face of the base portion 8, for example a top face, and the female engaging device 1 having the engaging mechanism includes on the side edge 4 a base portion 8 so as to cover the side edge 4 of the tape 3 and a female piece 33 having an engaging hole 34 in which the engaging protrusion 29 is to be inserted at a front end portion and provided so as to protrude forward from a front face of the base portion 8.

Finally, there is provided a male/female engaging device with tape, wherein the male engaging device 2 having the hooking mechanism includes on the side edge 4 a base portion 8 so as to cover the side edge 4 of the tape 3, and engaging protrusions 29 having an engaging head portion 35 at a tip thereof, the engaging protrusion 29 being provided on a top face or a bottom face of the base portion 8, for example top face, and the female engaging device 1 having the engaging mechanism including on the side edge 4 a base portion 8 so as to cover the side edge 4 of the tape 3. A female piece 33 is protruded forward from front surface of the base portion 8, having a guide groove 37 for guiding the engaging protrusion 29 from a front end to the inner side, an engaging hole 38 containing engaging portions 39 capable of engaging the engaging protrusion 29 at a deepest portion of the guide groove 37, such that both the base portions 8 are capable of making contact with each other when the female engaging device 1 engages the male engaging device 2.

BRIEF DESCRIPTION OF THE DRAWINGS

FIG. 20 is a lateral sectional view of a well known male/female hooking tape.

FIG. 21 is a perspective view of another well known engaging/disengaging device with tape.

DESCRIPTION OF THE PREFERRED EMBODIMENTS

Figure 1:
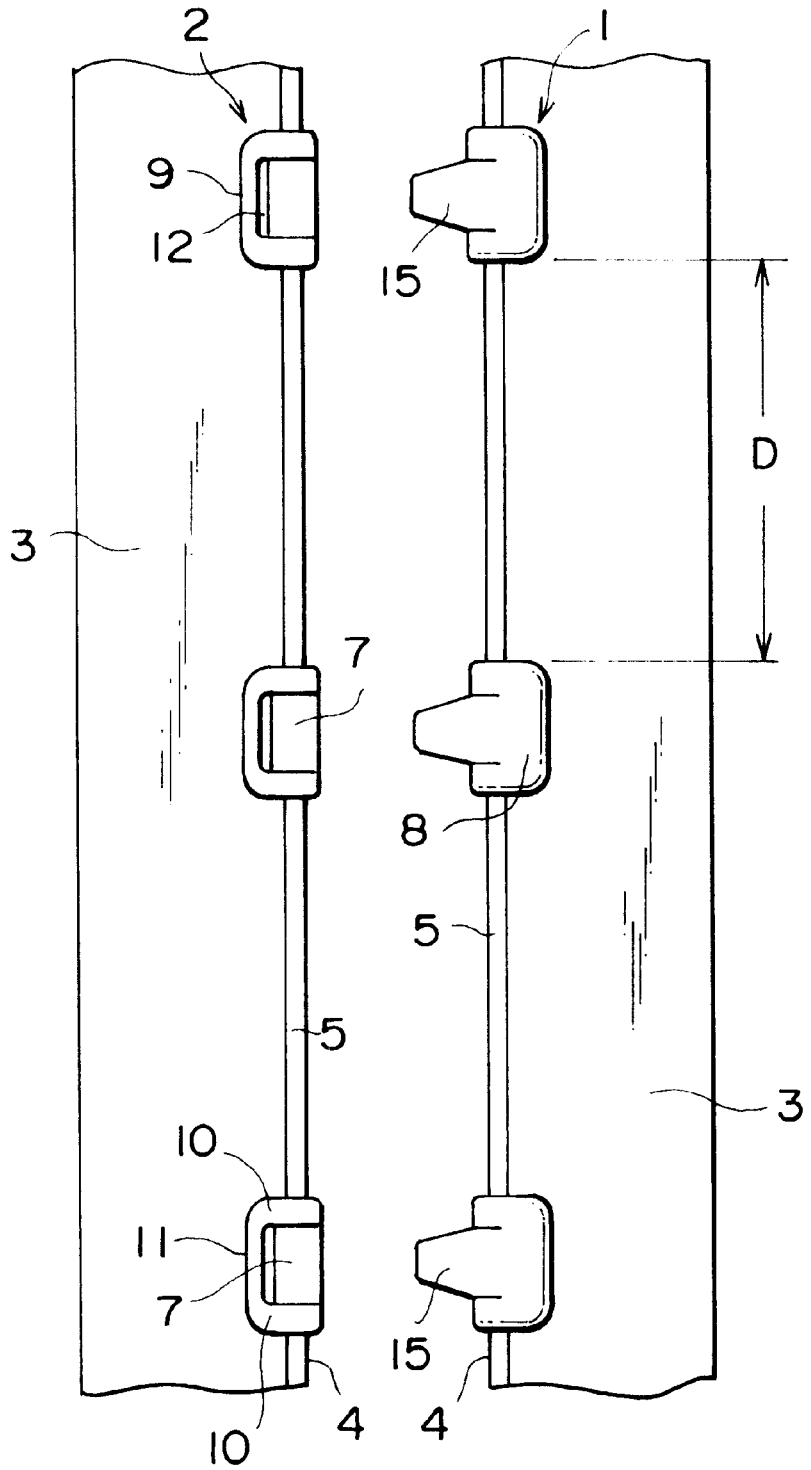
FIG. 1 is a front view of a first embodiment of a male/female engaging device with tape.

Hereinafter, the preferred embodiments of the male/female engaging device with tape of the present invention will be described in detail with reference to the accompanying drawings.

In the male/female engaging device with tape of the present invention, female engaging devices 1 having an engaging mechanism are mounted on one of opposing side edges 4 of a pair of narrow width tapes 3 and male engaging devices 2 having a hooking mechanism are mounted on the side edge 4 of the other tape 3 at a predetermined interval. Alternatively, the female engaging devices 1 and the male engaging devices 2 are mounted on the side edge 4 of the narrow width tape 3 alternately at a predetermined interval. By arranging the female engaging devices 1 and male engaging devices 2 at some interval, it prevents the hardening of the side edge 4 of the tape 3 when the female engaging devices 1 and male engaging devices 2 are disposed on the side edge 4 of each tape 3 too closely, so that the tape 3 can be bent or twisted easily. The interval D between the respective female engaging devices 1 and male engaging device 2 is preferable to be more than a width of a single female engaging device 1 or male engaging device 2 in the longitudinal direction of the tape 3.

The tape 3 on which the female engaging device 1 and the male engaging device 2 are to be mounted is formed by knitting or weaving synthetic fiber of polyamide base or polyester base and a expanded core portion 5 is formed on the side edge 4 of the tape 3. The core portion 5 can be formed integrally by knitting or weaving a core thread or sewing the core thread integrally.

In the male/female engaging device with tape of any embodiment of the present invention, the female engaging devices 1 and male engaging devices 2 are molded integrally of thermoplastic resin such as polyamide, polyacetal, polypropylene, polybutylene terephthalate by injection molding or extrusion molding on the opposing side edges 4 of a pair of the tapes 3 around each of the core portion 5 or on the side edge 4 of the flat tape 3 such that they are arranged at a predetermined interval.

Figure 2:
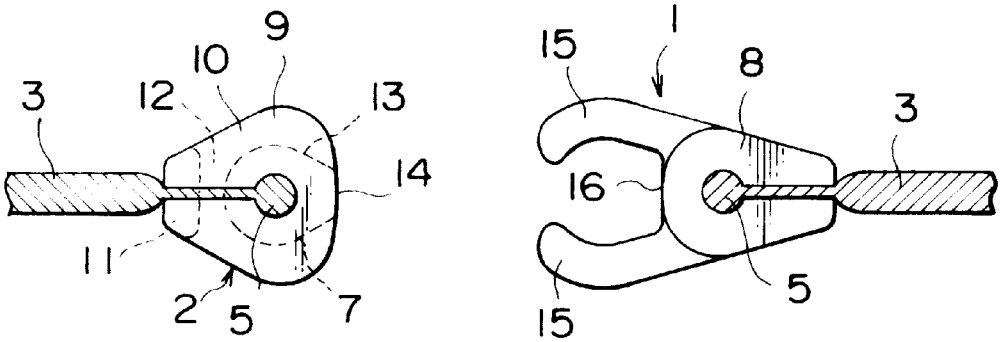
FIG. 2 is a bottom view of the same male/female engaging device.
Figure 3:
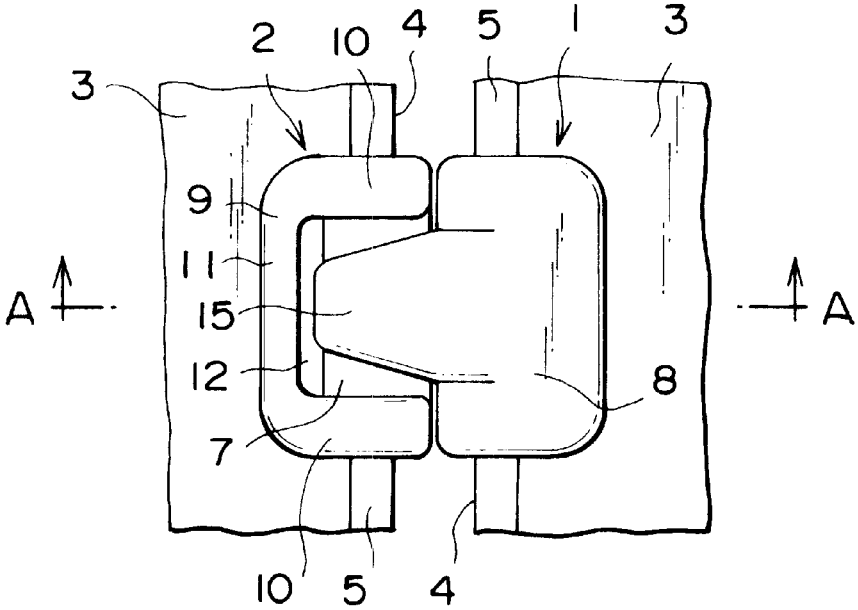
FIG. 3 is a front view of a principal portion showing an engagement state of the male/female engaging device with tape.
Figure 4:
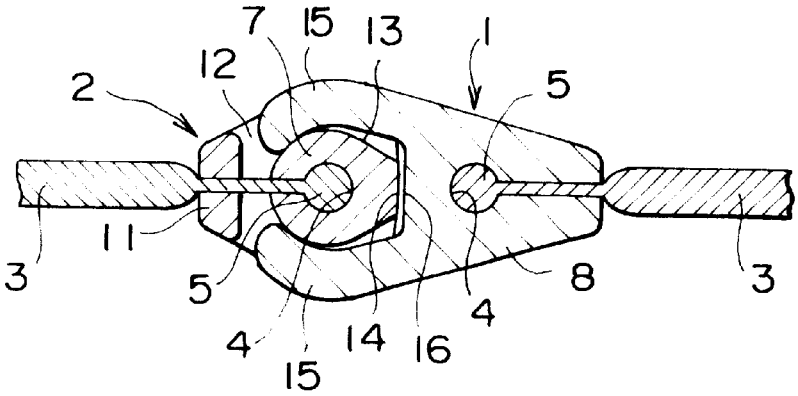
FIG. 4 is a sectional view taken along the line A—A of the male/female engaging device with tape.

In the female/male engaging device with tape in a first embodiment shown in FIGS. 1 to 4, the male engaging device 2 having a hooking mechanism is attached to the side edge 4 of the tape 3 by molding a substantially cylindrical-shaped hooking portion 7 so as to cover the core portion 5 provided on the side edge 4 of the tape 3 as shown in FIG. 1 and 2. An U-shaped frame portion 9 is provided from both sides of the hooking portion 7 to an inner position of the tape 3. The frame portion 9 is formed of a wall 10 and a connecting portion 11 and molded integrally to sandwich tape 3. In the hooking portion 7, as shown in FIG. 4, an end face 14 whose end portion is substantially flat is formed and a guide face 13, which is a sloping surface start rising up from the end face 14, is formed from this end face 14 as it goes deeper, so that an engaging piece 15 of the female engaging devices 1 can be inserted easily. Further, an accommodating portion 12 is formed in a gap between the hooking portion 7 and frame portion 9 in the inner part of the hooking portion 7 so that an end portion of the engaging piece 15 is accommodated and the end portion of the engaging piece 15 can be moved slightly in a depth direction of the accommodating portion 12 in this gap.

Although the embodiment of the male engaging device 2 has been described about a case in which a sectional shape of the hooking portion 7 is substantially cylindrical, the shape of the hooking portion 7 may not be always cylindrical but may be oval or polygon such as pentagon. Any shape may be used as long as the guide face 13 is provided on the side of the hooking portion 7 to which the engaging piece 15 of the female engaging devices 1 is inserted.

In the female engaging devices 1 having the engaging mechanism, as shown in FIGS. 1 and 2, a base portion 8 in which an outside edge of its sectional shape is wider is formed so as to cover a core portion 5 provided on the side edge 4 of the tape 3 to be mounted on the side edge 4 of the tape 3 and then, a pair of elastically deformable engaging pieces 15 are provided vertically such that a front end thereof is open from a center of each of an upper edge and a lower edge of the front face of the base portion 8, and the engaging pieces 15 have a horse shoe section so that a width thereof becomes narrower as they go to the front. The pair of the engaging pieces 15 move along the guide faces 13 formed on the hooking portion 7 of the male engaging device 2 while widening a gap gradually as shown in FIGS. 3 and 4. When they go beyond the hooking portion 7, the engaging pieces 15 are elastically returned to their original shape so that they enter the accommodating portion 12, and engage the accommodating portion 12 such that they sandwich the hooking portion 7 from above and below. A bottom face 16 of the engaging piece 15 is flat that it is capable of being in contact with the end face 14 of the hooking portion 7. Of course, the base portion 8 on both sides of the engaging piece 15 is constructed to be in contact with an end face 14 of the hooking portion 7 and front ends of the side walls 10.

Although the embodiment of the female engaging device 1 has been described about a case in which a sectional shape of the base portion 8 is trapezoidal and the sectional shape of the engaging pieces 15 is a C shape, the sectional shape of the base portion 8 may not be always trapezoid, but may be of other shape such as rectangular or circular as long as it covers the side edge 4 of the tape 3. Further, a sectional shape of the engaging piece 15 may not always be horse shoe shape but may be a horizontal V shape. If there is a portion which coincides with an outer shape of the hooking portion 7 of the male engaging device 2 and can be elastically deformed to hook, that shape has an engaging function. Therefore, any shape may be used if it is capable of being elastically deformed and has a hooking portion.

Therefore, when the female engaging devices 1 and male engaging device 2 engage each other, they make engagement at a position inside of the side edge 4 of the tape 3 on which the male engaging device 2 and female engaging device 1 are mounted. Thus, a distance between the side edges 4 of the right and left tapes 3 can be narrowed as much as possible, which means because the male engaging device 2 in the male/female engaging device with tape of this embodiment is so constructed that it is not protruded outward of the side edge 4 of the tape 3 as in the conventional product, the interval between the right and left tapes 3 can be formed narrower. Further, because when the female engaging device 1 and male engaging device 2 engages each other, the two engaging pieces 15 above and below sandwich the hooking portion 7 from above and below, even if twisting action is applied between the female engaging device 1 and male engaging device 2, they keep a strong engaging strength against the twisting, so that the engaging state can be maintained. Further, because the side walls 10 of the frame portion 9 exist on both sides of the engaging piece 15, even if a pulling action is applied in the longitudinal direction of the tape 3, the engaging piece 15 makes contact with the side wall 10 so as to prevent a relative motion of the respective parts thereby maintaining a secure engaging state.

Figure 5:
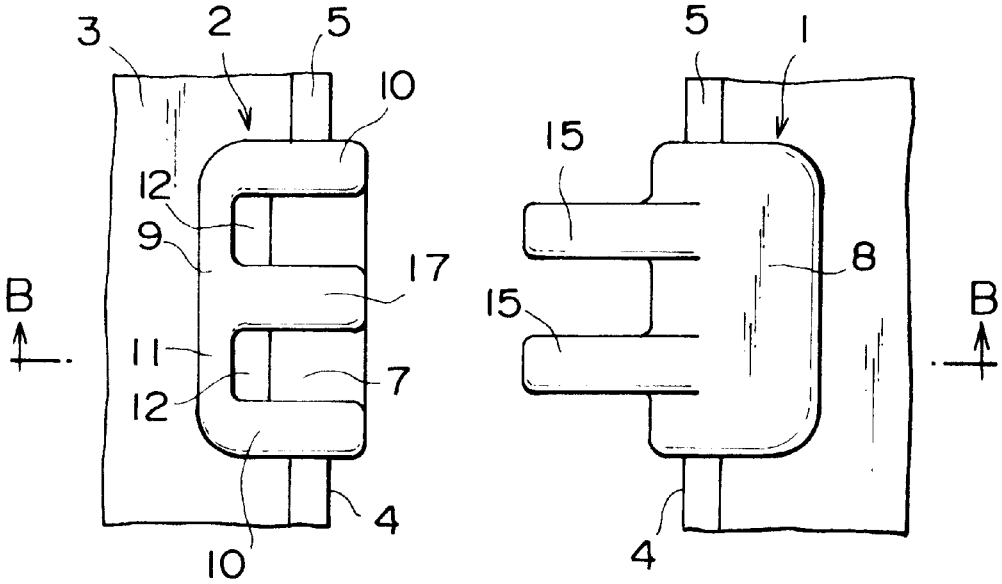
FIG. 5 is a front view of principal portions of the male/female engaging device with tape according to a modification of the first embodiment.
Figure 6:
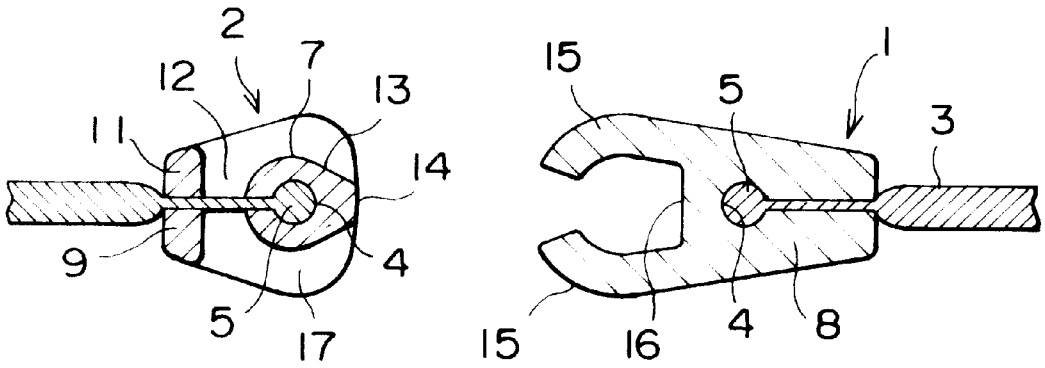
FIG. 6 is a sectional view taken along the line B—B of the male/female engaging device with tape.
Figure 7:
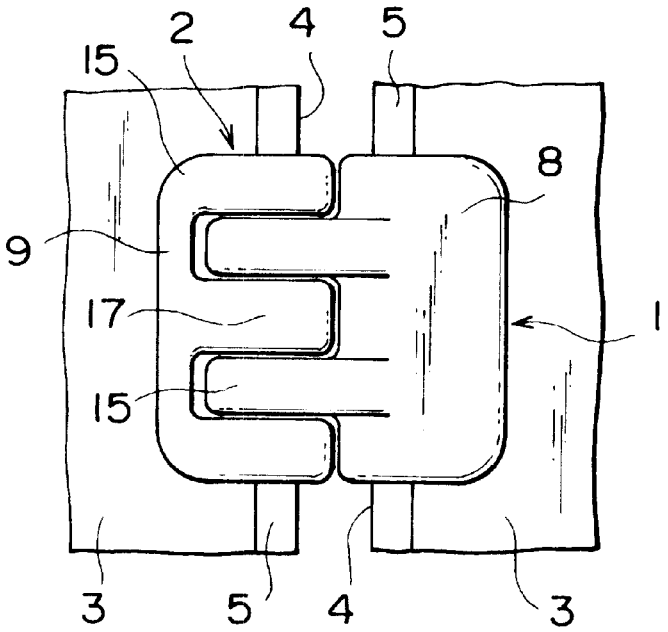
FIG. 7 is a front view of principal portions showing an engagement state of the male/female engaging device with tape.

The male/female engaging device with tape shown in FIGS. 5 to 7 indicates a modification of the first embodiment. The male engaging device 2 having a hooking mechanism is mounted on the side edge 4 of the tape 3 by molding a substantially cylindrical hooking portion 7 so as to cover the core portion 5 disposed on the side edge 4 of the tape 3. A U-shaped frame portion 9 is provided from both ends of the hooking portion 7 to an inner position of the tape 3 so as to sandwich the tape 3. The frame portion 9 comprises side walls 10 and a connecting portion 11. As shown in FIG. 5, a partition wall 17 having the same shape as the side wall 10 is arranged in the midst of the connecting portion 11 so that two small accommodating portion 12 are formed in the hooking portions 7. By providing several partition walls 17, plural accommodating portions 12 may be provided freely.

In the hooking portion 7, an end face 14 whose front end is substantially flat is formed as shown in FIG. 6 and a guide face 13 having a rising gradient as it goes deeper is formed on each of upper and lower faces from this end face 14. Further, an accommodating portion 12 with a gap is formed between hooking portion 7 and frame portion 9 so as to accommodate the engaging piece 15.

In the female engaging devices 1 having the engaging mechanism, as shown in FIG. 5, a trapezoidal base portion 8 having such a sectional shape in which an outside edge is wider is molded so as to cover the core portion 5 provided on the side edge 4 of the tape 3, and two pairs of the engaging pieces 15 above and below are provided side by side such that their ends are open from the base potion 8 to the front end, having a C-shape cross section and are elastically deformable. The engaging pieces 15 engage the two accommodating portions 12 provided in the hooking portion 7 of the male engaging device 2 in a state that they hook thereon from above and below, so as to achieve balanced engagement. The other structure and configuration are the same as the first embodiment.

Figure 8:
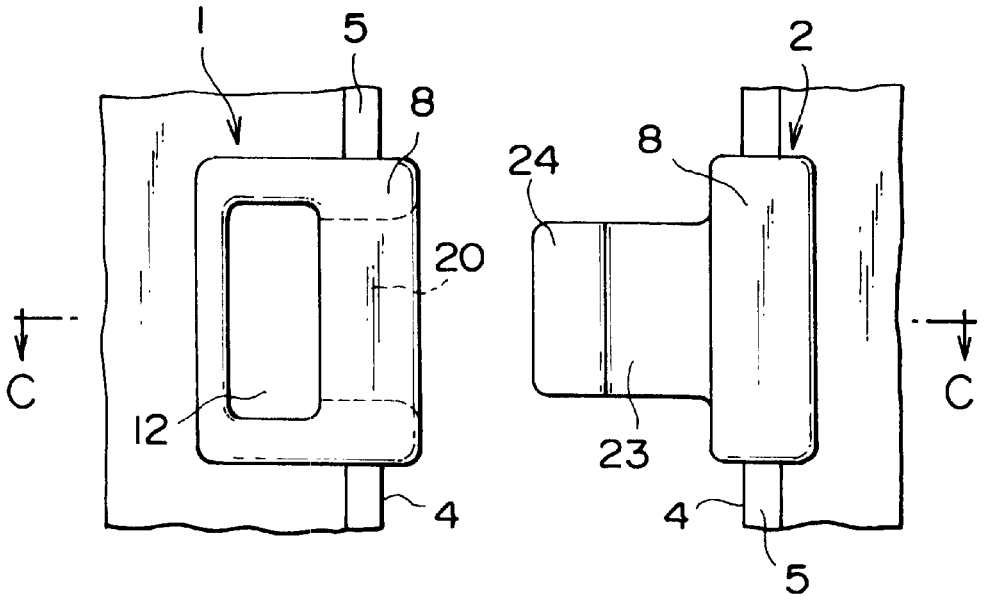
FIG. 8 is a rear view of principal portions of a second embodiment of the male/female engaging device with tape.
Figure 9:
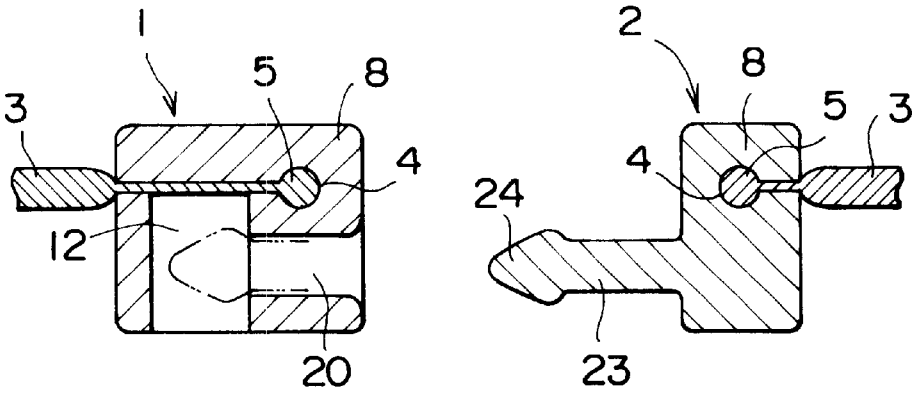
FIG. 9 is a sectional view taken along the line C—C of the male/female engaging device with tape.
Figure 8:
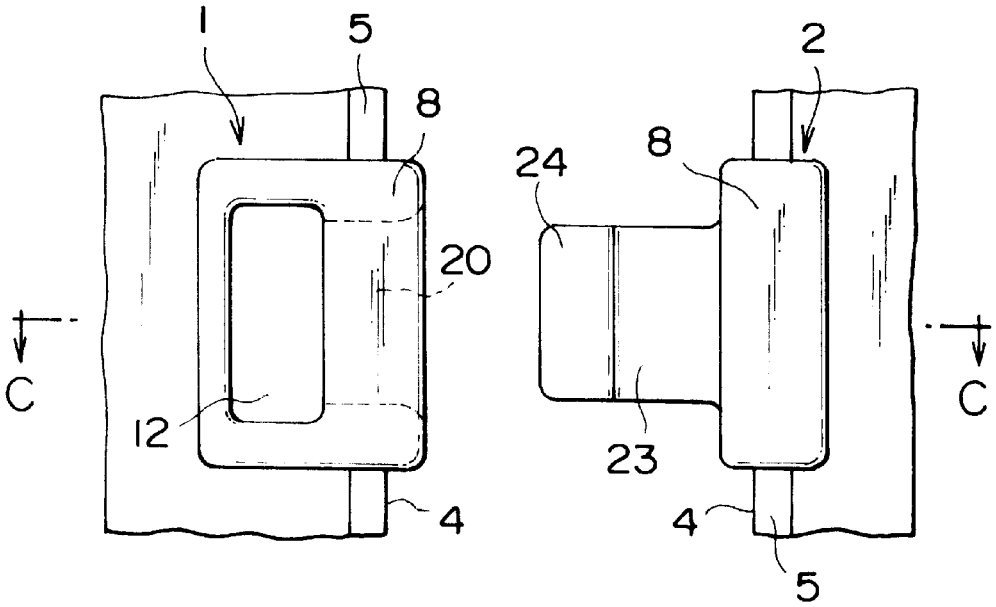
Figure 9:
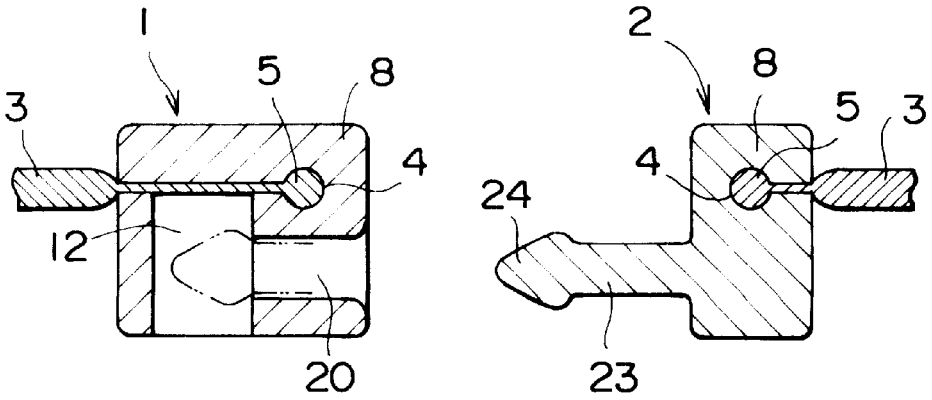
Figure 10:
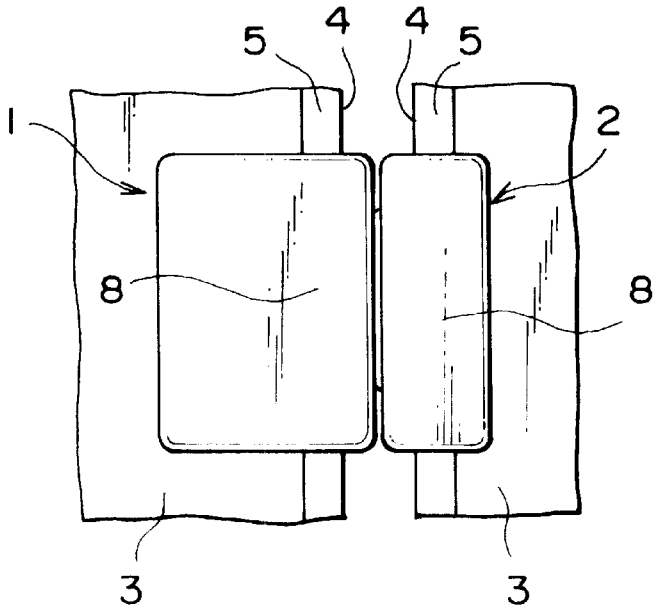
FIG. 10 is a front view of principal portions showing an engagement state of the male/female engaging device with tape.

In the male/female engaging device with tape of the second embodiment shown in FIGS. 8 to 10, as shown in FIGS. 8 and 9, in the female engaging portion 1 having an engaging function, a box-like base portion 8 whose outer side is thick is formed so as to cover the core portion 5 provided on the side edge 4 of the tape 3, so as to be mounted on the side edge 4 of the tape 3. Then, a rectangular engaging hole 20 is made near a lower edge of the front face of the base portion 8 so that a male piece 23 of the male engaging device 2 is capable of being inserted. The box-like base portion 8 is formed in a large size such that the surface is extended to a deeper side. Then, a hollow accommodating portion 12 is provided in a bottom face at a front end of the engaging hole 20, so that an expanded head portion 24 formed at a front end of the male piece 23 is accommodated and the expanded head portion 24 is capable of moving slightly in the depth direction of the accommodating portion 12.

As shown in FIGS. 8 and 9, the male engaging device 2 having the hooking mechanism is mounted on the side edge 4 of the tape 3 by molding a prismatic, trapezoidal base portion 8 so as to cover the core portion 5 provided on the side edge 4 of the tape 3, and the male piece 23 capable of passing through the engaging hole 20 of the female engaging devices 1 is provided near the lower edge of the front face of the base portion 8 so as to protrude forward. By providing the male piece 23 with the expanded head portion 24 whose front end is expanded like an arrow tip, the male engaging device 2 is capable of engaging the engaging hole 20 of the female engaging device 1 by snap action. When the female engaging device 1 is engaged with the male engaging device 2, end faces of both the base portions 8 make contact with each other to maintain a stabilized state. It is important that the expanded head portion 24 is not expanded excessively.

Figure 11:
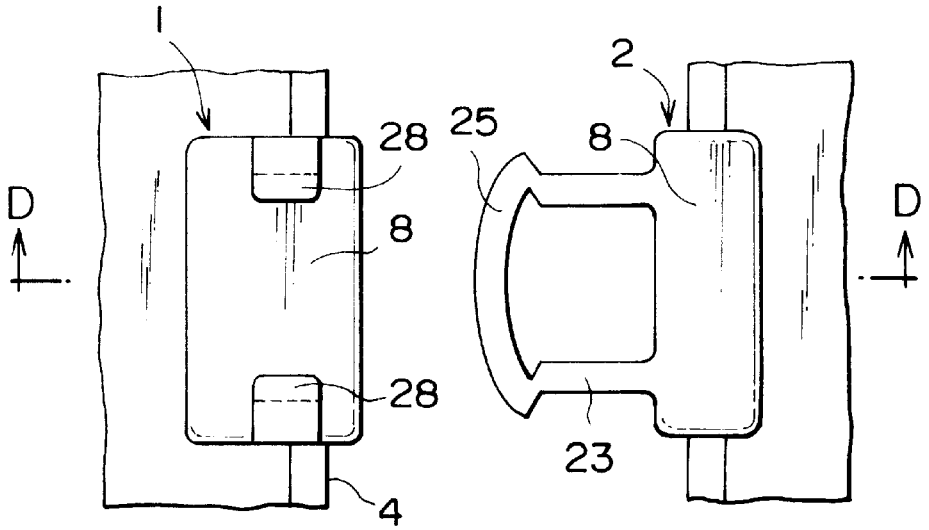
FIG. 11 is a front view of principal portions of the male/female engaging device with tape according to a modification of the second embodiment.
Figure 12:
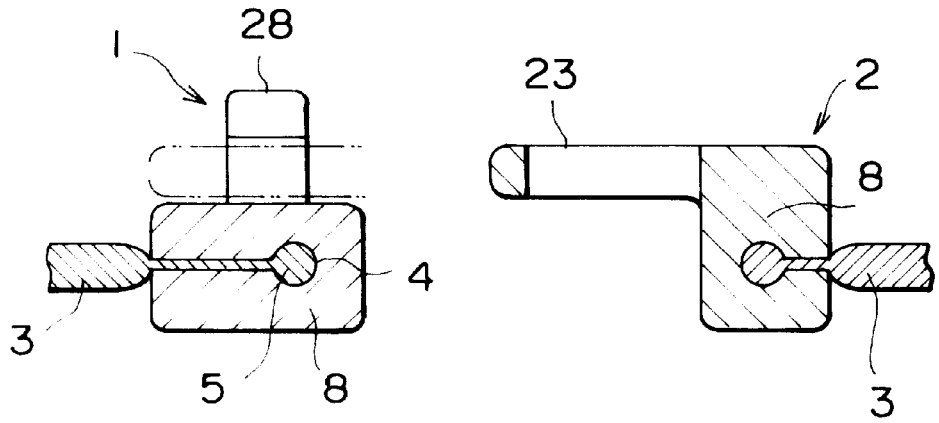
FIG. 12 is a sectional view taken along the line D—D of the male/female engaging device with tape.
Figure 13:
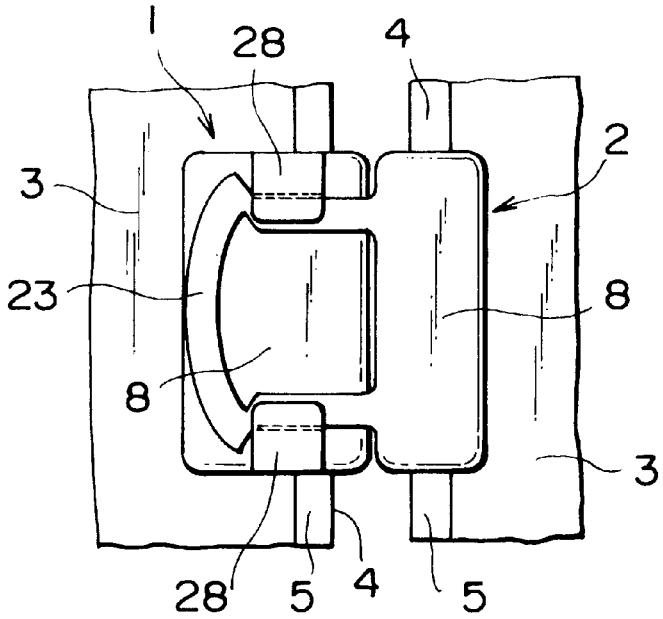
FIG. 13 is a front view of principal portions showing an engagement state of the male/female engaging device with tape.

The male/female engaging device shown in FIGS. 11 to 13 indicate a modification of the second embodiment. In the female engaging device 1 having an engaging mechanism, as shown in FIGS. 11 and 12, a long prismatic base portion 8 is molded on the surface of tape 3 so as to cover the core portion 5 provided on the side edge 4 of the tape 3 so as to be mounted on the side edge 4 of the tape 3. Then, a pair of hook-shaped engaging protrusions 28 are provided on both sides in the longitudinal direction of the tape 3 of the top surface of the base portion 8 such that they oppose each other and their protruded sides are directed inward. Consequently, the male piece 23 of the male engaging device 2 is capable of being inserted.

As shown in FIGS. 11 and 12, the male engaging device 2 having the hooking mechanism is attached to the side edge 4 of the tape 3 so as to cover the core portion 5 provided on the side edge 4 of the tape 3 such that the prismatic base portion 8 is protruded perpendicular to the surface of the tape 3. Then, the male piece 23 is provided on the front face of the base portion 8 so as to protrude forward from its upper edge. An expanded head portion 25 is formed on a front end of the male piece 23 such that it is protruded on both sides in the longitudinal direction of the tape 3, and when inserted in between the engaging protrusion 28 of the female engaging device 1, it is elastically deformed so as to be engaged. Although the male piece 23 may be of a flat sheet, a center portion of the male piece 23 is hollowed out as shown in the Figure so as to form a frame body. As a result, the expanded head portion 25 of the male piece 23 is provided with elastic force so that engaging/disengaging operation for the female engaging devices 1 and male engaging device 2 can be carried out easily.

Figure 14:
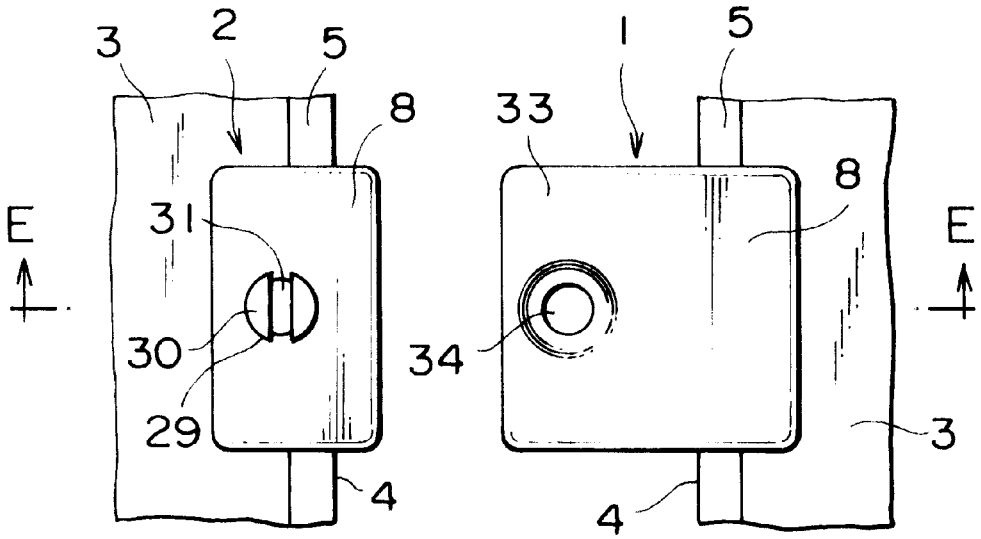
FIG. 14 is a front view of principal portions of a third embodiment of the male/female engaging device with tape.
Figure 15:
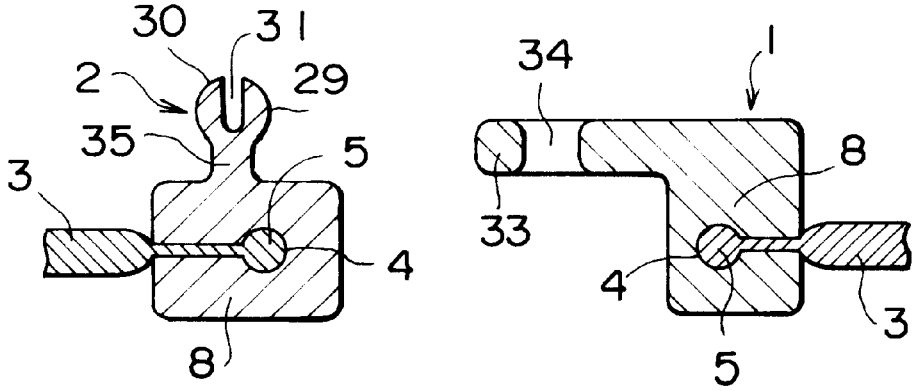
FIG. 15 is a sectional view taken along the line E—E of the male/female engaging device with tape.
Figure 16:
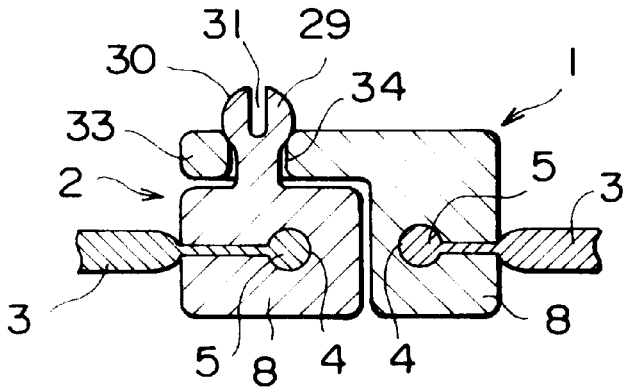
FIG. 16 is a sectional view of principal portions showing an engagement state of the male/female engaging device with tape.

In the male/female engaging device with tape according to a third embodiment shown in FIGS. 14 to 16, the male engaging device 2 having the hooking mechanism is attached to the side edge 4 of the tape 3 so as to cover the core portion 5 provided on the side edge 4 of the tape 3 such that a prismatic base portion 8 having a long rectangular section is molded. As shown in FIG. 14 and 15, an engaging protrusion 29 comprising a neck portion 35 provided at a trunk portion thereof and an engaging head portion 30 having a spherical head portion is provided in the center of the top surface of the base portion 8 so as to protrude. Then, a groove portion 31 is provided at a top portion of the engaging head portion 30 such that it is dented to provide the engaging head portion with elasticity. As a result, engagement with an engaging hole 34 formed in the male piece 33 of the female engaging device 1 is facilitated.

As shown in FIGS. 14 and 15, the female engaging device 1 having the engaging mechanism is attached to the side edge 4 of the tape 3 so as to cover the core portion 5 provided on the side edge 4 of the tape 3, such that a prismatic base portion 8 is molded on the tape 3 so as to protrude perpendicularly. Then, a female piece 33 is provided on the front face of the base portion 8 from the front edge to forward so as to protrude, and a circular engaging hole 34 having a larger diameter than an outer size of the neck portion 35 of the engaging protrusion 29 is provided in the center near a front end of this female piece 33, so that the engaging head portion 30 of the male engaging device 2 can be engaged with this engaging hole 34 by snap action.

The female engaging devices 1 and the male engaging device 2 are engaged with each other by pressing from above and below. Upon engagement, the engaging hole 34 compresses the engaging head portion 30 and after the engagement, the neck portion 35 of the engaging protrusion 29 is capable of moving slightly in a gap within the engaging hole 34. As a result, end faces of both the base portions 8 keep contact with each other so that a stabilized engagement is maintained.

Figure 17:
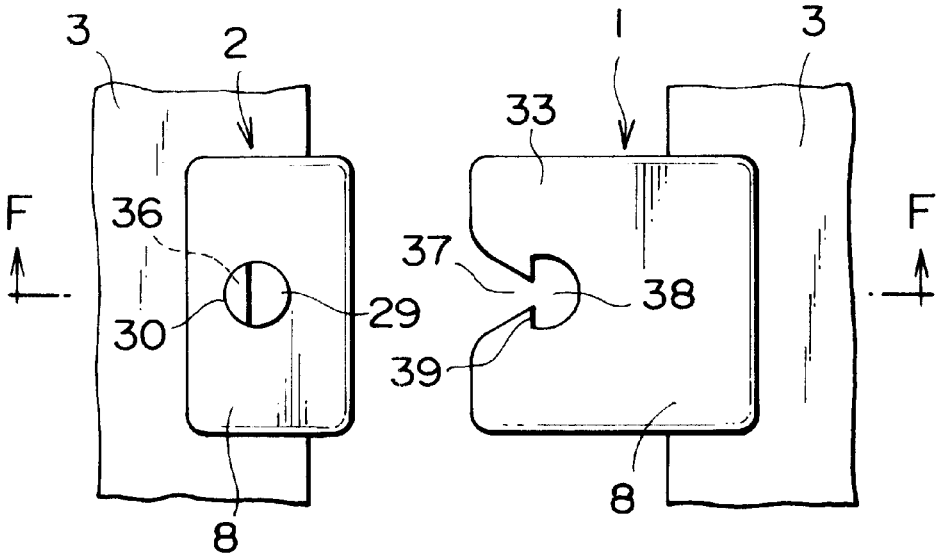
FIG. 17 is a front view of principal portions of the male/female engaging device with tape according to a modification of the third embodiment.
Figure 18:
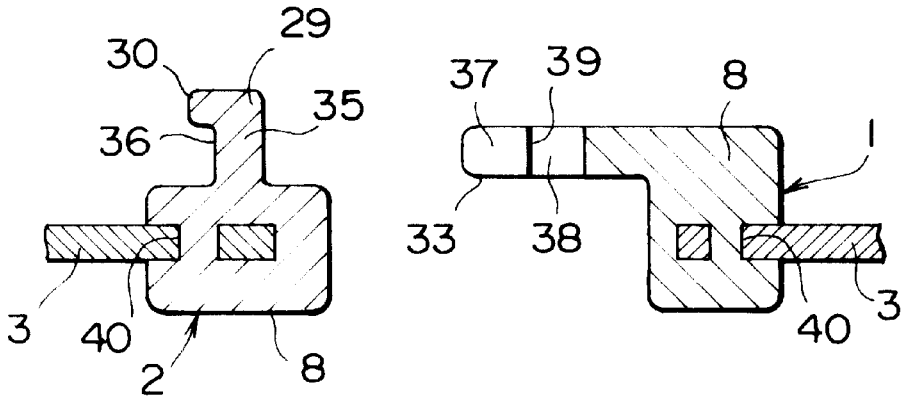
FIG. 18 is a sectional view taken along the line F—F of the male/female engaging device with tape.
Figure 19:
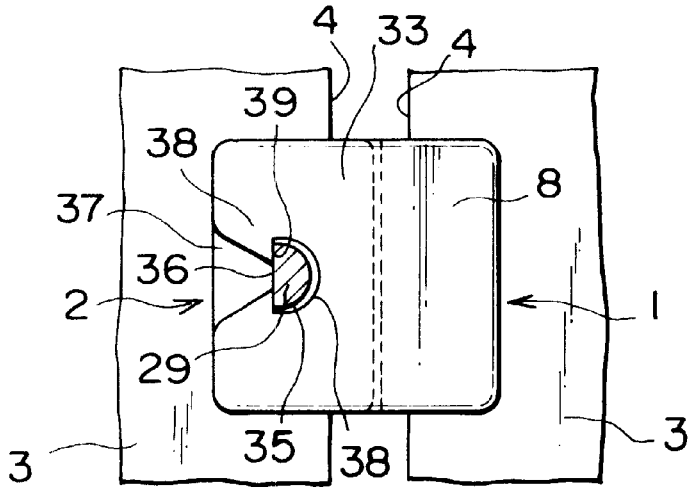
FIG. 19 is a partially broken front view of principal portions showing an engagement state of the male/female engaging device with tape.

A male/female engaging device with tape shown in FIGS. 17 to 19 indicates a modification of the third embodiment. As shown in FIG. 17 and 18, the male engaging device 2 having the engaging mechanism is attached to the side edge 4 of the tape 3 so as to cover the side edge 4 of the flat tape 3 such that a prismatic base portion 8 is molded. Upon molding of the base portion 8, upper and lower portions of the base portions 8 are connected integrally through a hole portion 40 provided at an end of the tape 3 so as to achieve a firm fixing of the tape 2.

An engaging protrusion 29 is provided in the center of the top face of the base portion 8 so as to protrude. Then, a step portion 36 is formed by cutting out a lower portion of the trunk portion of the engaging protrusion 29 so as to form a neck portion 35 at the trunk portion and a hook-shaped engaging head portion 30 directed inward of the tape 3 at a tip thereof. As a result, when the female engaging device 1 engages the male engaging device 2, the female piece 33 is not capable of escaping upward.

As shown in FIGS. 17 and 18, the female engaging device 1 having the engaging mechanism is attached to the side edge 4 of the tape 3 so as to cover the side edge 4 of the flat tape 3 such that a prismatic base portion 8 is molded so as to protrude perpendicularly with respect to the tape 3. Upon molding of the base portion 8, upper and lower portions of the base portions 8 are connected integrally through a hole portion 40 provided at an end of the tape 3 so as to achieve a firm fixing.

A female piece 33 is provided on the front face of the base portion 8 so as to protrude forward from its upper edge and then a guide groove 37 for guiding an insertion of the engaging protrusion 29 of the male engaging device 2 is provided from a front end of this female piece 33 toward the center portion thereof. Then, an engaging hole 38 is provided in the deepest portion of the guide groove 37. Engaging portions 39 protruded to the guide groove 37 are provided on both sides of the deepest portion of the guide grooves 37 so that the engaging hole 38 coincides with a sectional shape of the neck portion 35 of the engaging protrusion 29. Consequently, the engaging portions 39 restrict an escape of the engaging protrusion 29 when the female engaging devices 1 engages the male engaging device 2.

An inner shape of the engaging hole 34 is larger than an outside shape of the neck portion 35 of the engaging protrusion 29 so that there is a gap between the both. Thus, the engaging protrusion 29 is capable of moving slightly in the engaging hole 34 such that both the base portions 8 maintain a stabilized engagement. Meanwhile, engagement and disengagement of the female engaging device 1 and male engaging device 2 can be achieved along one flat operation.

The male/female engaging device with tape of the present invention has the structure described above and with this structure, the following effects are achieved.

According to the present invention, there is a male/female engaging device with tape, wherein female engaging devices 1 having an engaging mechanism are attached to one of the side edges 4 of an opposing pair of tapes 3 while male engaging devices 2 having a hooking mechanism are attached to the other side edge 4, such that engagement or disengagement between the female engaging device 1 and male engaging device 2 is carried out at the inner side of the tape 3 with respect to the side edge 4 of the tape 3 on which the female engaging device 1 or male engaging device 2 is attached. As a result, the gap between the side edges 4 of the right and left tapes 3 can be made as small as possible, so that a male/female engaging device with tape having a beautiful and fashionable appearance can be obtained.

According to the present invention, there is provided a male/female engaging device with tape, wherein the male engaging device 2 having the hooking mechanism covers the side edge 4 of the tape 3 and has a hooking portion 7 having guide faces 13 at an outer side thereof and a frame portion 9 which is formed in a U shape directed inward from both ends of the hooking portion 7 and sandwiching the tape 3, and the female engaging device 1 having the engaging mechanism includes a base portion 8 for covering the side edge 4 of the tape 3 and engaging pieces 33, for engaging the hooking portion 7 provided on a front face of the base portion so as to protrude. Because the male/female engaging device is symmetrical with respect to the front and rear sides thereof, either surface may be exposed outside. Thus, it is convenient for use and an engaging operation can be carried out easily. Further, even if a twisting action or a pulling action is applied in engagement, a strong engagement holding force is secured. Thus, a male/female engaging device with tape capable of maintaining a stabilized engaging force without looseness can be obtained.

According to the present invention, there is provided a male/female engaging device with tape, wherein the male engaging device 2 having the hooking mechanism covers the side edge 4 of the tape 3 and contains an hooking portion 7 having guide faces 13 at an outer side thereof, a frame portion 9 which is formed in a U shape directed inward from both ends of the hooking portion 7 and sandwiched to the tape 3 and a plurality of accommodating portions 12 provided in the hooking portion 7 such that partition walls 17 are connected to the frame portion 9, and the female engaging device 1 having the engaging mechanism includes a base portion 8 for covering the side edge 4 of the tape 3 and plural engaging pieces 15 which engage the hooking portions 7 provided on a front face of the base portion 8 so as to protrude. Because the male/ female engaging device is symmetrical with respect to the front and rear sides thereof, any surface may be exposed outside. Thus, it is convenient for use and a balanced engagement can be achieved. Therefore, a male/female engaging device with tape capable of maintaining a stabilized engaging state without looseness can be obtained.

According to the present invention, there is provided a male/female engaging device, wherein the female engaging device 1 having the engaging mechanism includes a base portion 8 so as to cover the side edge 4 of the tape 3 and an engaging hole 34 provided on a front face of the base portion 8 such that a male piece 23 is capable of passing through, and the male engaging device 2 having the hooking mechanism includes a base portion 8 so as to cover the side edge 4 of the tape 3 and the male piece 23 having an expanded head portion 25 at a front end thereof and protruded forward from the front face of the base portion 8. As a result, a rigid male/female engaging device with tape can be produced and further, an engaging operation can be carried out easily and a stabilized engagement state without looseness can be maintained.

According to the present invention, there is provided a male/female engaging device, wherein the female engaging device 2 having the engaging mechanism includes a base portion 8 so as to cover the side edge 4 of the tape 3 and hook shaped engaging protrusions 29 provided on both sides facing each other such that the male piece 23 is capable of being inserted therebetween so that they are directed inward on top or bottom face of the base portion 8, and the male engaging device 2 having the hooking mechanism includes a base portion 8 so as to cover the side edge 4 of the tape 3 and the male piece 23 having an expanded head portion 25 with its end expanded at a front end and protruded forward from the front face of the base portion 8. An engaging/disengaging operation of the female/male engaging device can be carried out easily and a stabilized engagement state without looseness can be maintained.

According to the present invention, there is provided a male/female engaging device, wherein the male engaging device 2 having the hooking mechanism includes a base portion 8 so as to cover the side edge 4 of the tape 3 and engaging protrusions 28 having an engaging head portion 30 at a tip thereof, the engaging protrusion 29 being provided on a top face or a bottom face of the base portion 8 so as to protrude and the female engaging device 1 having the engaging mechanism includes a base portion so as to cover the side edge of the tape and a female piece 33 having an engaging hole 34 in which the engaging protrusion 29 is to be inserted at a front end portion and provided so as to protrude forward from a front face of the base portion 8. As a result, a rigid male/female engaging device with tape having a simple structure can be produced. Especially a disengaging operation of male/female engaging devices can be carried out very easily and a stabilized engagement state without looseness can be maintained.

According to the present invention, there is provided a male/female engaging device, wherein the male engaging device 2 having the hooking mechanism includes a base portion 8 so as to cover the side edge 4 of the tape 3 and engaging protrusions 29 having an engaging head portion 30 at a tip thereof, the engaging protrusion 29 being provided on a top face or a bottom face of the base portion 8 so as to protrude and the female engaging device 1 having the engaging mechanism including a base portion 8 so as to cover the side edge 4 of the tape 3 and a female piece 23 having a guide groove 37 extended from a front end thereof and an engaging hole 34 having engaging portions 39 at a deepest portion of the guide groove, and the female piece 33 is protruded forward from the front surface of the base portion 8. As a result, a rigid male/female engaging device having a simple structure can be produced. Particularly, an engaging operation for engaging the female and male engaging devices by combination can be carried out very easily and a stabilized engagement state without looseness is obtained. As described above, the present invention is capable of exerting very remarkable effects.

What is claimed is:

1. A male/female engaging device with tape, wherein female engaging devices having an engaging mechanism are attached to one of the side edges opposing each other of a pair of tapes while male engaging devices having a hooking mechanism are attached to the other side edge, such that engagement or disengagement between the female engaging device and the male engaging device is carried out inside of the tape with respect to the side edge of the tape on which the female engaging device or the male engaging device is attached, wherein the male engaging device having the hooking mechanism covers the side edge of the tape and has a hooking portion having guide faces at an outer side thereof and a frame portion which is formed in a U shape directed inward from both ends of the hooking portion and sandwiched to the tape, and the female engaging device having the engaging mechanism includes a base portion for covering the side edge of the tape and a vertical pair of engaging pieces for engaging the hooking portion provided on a front face of the base portion so as to protrude.

2. A male/female engaging device with tape, wherein female engaging devices having an engaging mechanism are attached to one of the side edges opposing each other of a pair of tapes while male engaging devices having a hooking mechanism are attached to the other side edge, such that engagement or disengagement between the female engaging device and the male engaging device is carried out inside of the tape with respect to the side edge of the tape on which the female engaging device or the male engaging device is attached, wherein the male engaging device having the hooking mechanism covers the side edge of the tape and has a hooking portion having guide faces at an outer side thereof, a frame portion which is formed in a U shape directed inward from both ends of the hooking portion and sandwiched to the tape, and a plurality of accommodating portions provided in the hooking portion such that partition walls are connected to the frame portion, and the female engaging device having the engaging mechanism includes a base portion for covering the side edge of the tape and plural vertical pairs of engaging pieces which engage the hooking portions provided on a front face of the base portion so as to protrude.

* * * * *